United States Patent [19]

Stein, Jr.

[11] 3,965,500

[45] June 29, 1976

[54] ADJUSTABLE BED WITH AUTOMATIC KNEE BREAK

[75] Inventor: William H. Stein, Jr., Batesville, Ind.

[73] Assignee: Hill-Rom Company, Inc., Batesville, Ind.

[22] Filed: Mar. 20, 1975

[21] Appl. No.: 560,224

[52] U.S. Cl. ..... 5/68; 5/66

[51] Int. Cl.[2] ..... A47C 3/32

[58] Field of Search ..... 5/66–69, 5/79, 80

[56] References Cited

UNITED STATES PATENTS

| | | | |
|---|---|---|---|
| 1,658,736 | 2/1928 | Ortmeier | 5/69 |
| 1,908,530 | 5/1933 | Nixon et al. | 5/67 |
| 3,191,196 | 6/1965 | Holm | 5/68 |

*Primary Examiner*—Casmir A. Nunberg

*Attorney, Agent, or Firm*—Haight, Hofeldt, Davis & Jambor

[57] ABSTRACT

An adjustable bed allowing the knee portion to automatically rise upon the elevating of the head portion. Alternately, when desired, the knee may remain flat while the head of the bed elevates. The mechanism elevating the knee connects to the structure which effecuates the raising of the head. This mechanism occupies one position when the knee accompanies the head portion in rising and a second position when the knee remains flat. Conveniently, this mechanism consists of a cam connected to the member elevating the head portion. The cam occupies a position where it contacts a cam follower on the knee portion of the bed when the knee rises and a second position where it does not contact the cam follower for the instance where the knee remains flat. These two positions of the cam may have rotational or translational separation from each other.

12 Claims, 8 Drawing Figures

E
H
76
95
98
97
78
96
77
83
86
81
82
85
99
59
84
91
90
39
79
38
101
100
112
110
111
113
107
106
105
102
104
70
69
66
65
67
55
60
56
57
110
105
35
40
103
6

ADJUSTABLE BED WITH AUTOMATIC KNEE BREAK

BACKGROUND

Adjustable beds, such as those in hospitals and nursing homes, generally include some mechanism for elevating the head portion of the bed. Raising this segment serves a number of different purposes. Commonly, elevating the head allows the use of the bed for such normal daily activities as eating, reading, watching television, and others. However, frequently the bed's occupant, with his toro elevated, tends to slide towards the foot of the bed due to gravitation. Elevating the knee portion of the bed helps to preclude this sliding.

Other situations may require an elevation of the head but with the knee remaining flat. One example includes a patient having undergone recent surgery of the lower abdominal area. Elevating the knee portion of this patient may place an undesirable strain upon the tissues in the incisional area.

Furthermore, the knee should remain flat for patients with circulatory problems in order to prevent or minimize clotting in their lower extremities. Also, a slight elevation of the head with no knee elevation improves the drainage removal of congestion for patients with respiratory ailments.

Orthopedic patients having a straight cast on a broken leg cannot have their knees elevated although they may wish to sit up by raising the head portion of the bed. Moreover, elevating the head but not the knee allows more facile entrance into and exit from the bed of a patient who has difficulty maneuvering.

Consequently, a number of beds have afforded a choice between the knee section remaining flat as the head section raises or the knee following the head section in coordinated motion. Nonetheless, they have suffered from such drawbacks as complicated and expensive mechanisms interconnecting the head and knee portions of the bed. Some have required an unacceptable exertion when manipulating the appropriate mechanisms to achieve the desired results.

With regards to the latter, E. C. Ortmeier, in his U.S. Pat. No. 1,658,736, shows a bed in which the knee must raise with the head to some extent before it can disengage and return to the flat position. Specifically, once elevated slightly, the operator must physically lift up the foot of the bed and remove it from the mechanism which flexes the knee. Aside from the physical burden of lifting the actual portion of the bed, this procedure also presents the danger of entrapping and injuring fingers. Moreover, after the head reaches its lowest position, the bed requires a repetition of the foregoing procedure to again disengage the knee-raising mechanism.

U.S. Pat. No. 3,398,411 to J. Douglass, shows a bed in which the knee-adjusting mechanism connects to the actual head portion of the bed itself. This structure, which thus must support the load of the knee portion, entails an appreciable added expense to the construction of the bed.

C. W. Pratt, in his U.S. Pat. No. 474,690, shows a bed which he attempts to convert into a chair by allowing the feet to lower as the head rises. By not allowing the knee portion of the bed to raise, the altered configuration aggravates the gravitation of the patient as well as the mattress to the foot of the bed, rather than precluding it. The modern efforts have rejected this early concept when providing a bed-ridden patient with a configuration in which to conduct daily activities.

In F. J. Burst et al.'s bed, disclosed in their U.S. Pat. No. 3,821,821, the entire mattress moves towards the head of the bed as the head portion raises. This, of course, allows the patient to remain near to the usual accessory equipment found at this end of the bed. The relative motion between two bed frames accomplishes this movement of the mattress. The knee adjusting mechanism utilizes this relative motion between the frames in order to, when desired, elevate the knee when the head rises. This device represents a significant accomplishment in the field of adjustable beds, but only has pertinence to those beds with the moving frames.

Consequently, the search continues for a mechanism that permits the knee section, when desired, to elevate with the head section while obviating the drawbacks of the previous devices.

SUMMARY

In order to provide the desired coordinated movement, an adjustable bed must first have a movable head portion. A head-adjusting means effects the desired movement of this head portion.

This type of bed, moreover, should also permit movement of its knee portion. To achieve the desired structure, the included knee-adjusting means must display a number of characteristics. First, it must possess an active configuration. In this active configuration, it serves to raise the knee portion of the bed above the normal flat position during at least a portion of the time that the head adjuster moves the head portion.

The knee-adjusting mechanism need not elevate the knee during all of the time that the head section rises. Where the head section, for example has only minimal elevation, the gravitation of the occupant does not represent an appreciable problem. Consequently, the knee may remain flat at this point. On the other hand, the knee, after reaching a certain elevation, for example 15° of knee flexing, will suffice to prevent gravitation even though the head section may elevate further. Consequently, the knee need not accompany the rising head section after reaching this elevation.

The knee-adjusting means must also have an inactive configuration. When occupying this latter configuration, it will not move the knee portion notwithstanding any elevation of the head portion.

Movable between the active and inactive configurations, the knee-adjusting means requires some mechanism for accomplishing this important motion. A shifting means performs this role.

Frequently, an adjustable bed includes an elongated member such as a long tube which rungs longitudinally under the mattress and spring. The tube moves translationally to change the elevation of the head section. Moved in one direction, it forces the head section to raise while the other direction results in the lowering of the head section. A hand crank, a motor, or both, produce the translational motion of the tube. When manually activated, the hand crank appears at the foot of the bed for the convenience of the attending personnel.

Conveniently, the knee-adjusting means may then connect to this translationally moving tube. More specifically, it may assume the form of a cam which moves translationally with the tube and urges against a cam follower on the knee section to effect its raising.

The cam then, of course, has two positions which it may occupy. In the active position, the longitudinal motion of the tube as it elevates the head section will force the cam against the cam follower on the knee portion to elevate it. In the inactive position, it will not contact the cam follower in a fashion to raise it.

Generally, the active cam surface projects upwards from the longitudinal tube to contact the cam follower when raising the knee section. Rotating it about the tube represents one method of placing it in its inactive configuration. A second method results from moving the cam longitudinally along the elongated member to a place where it cannot contact the cam follower over the entire range of motion of the longitudinal member. The cam also includes a retainer to insure that when in its active configuration, the force of the knee section transmitted through the cam follower does not displace it.

DETAILED DESCRIPTION

Figures 1, 2:
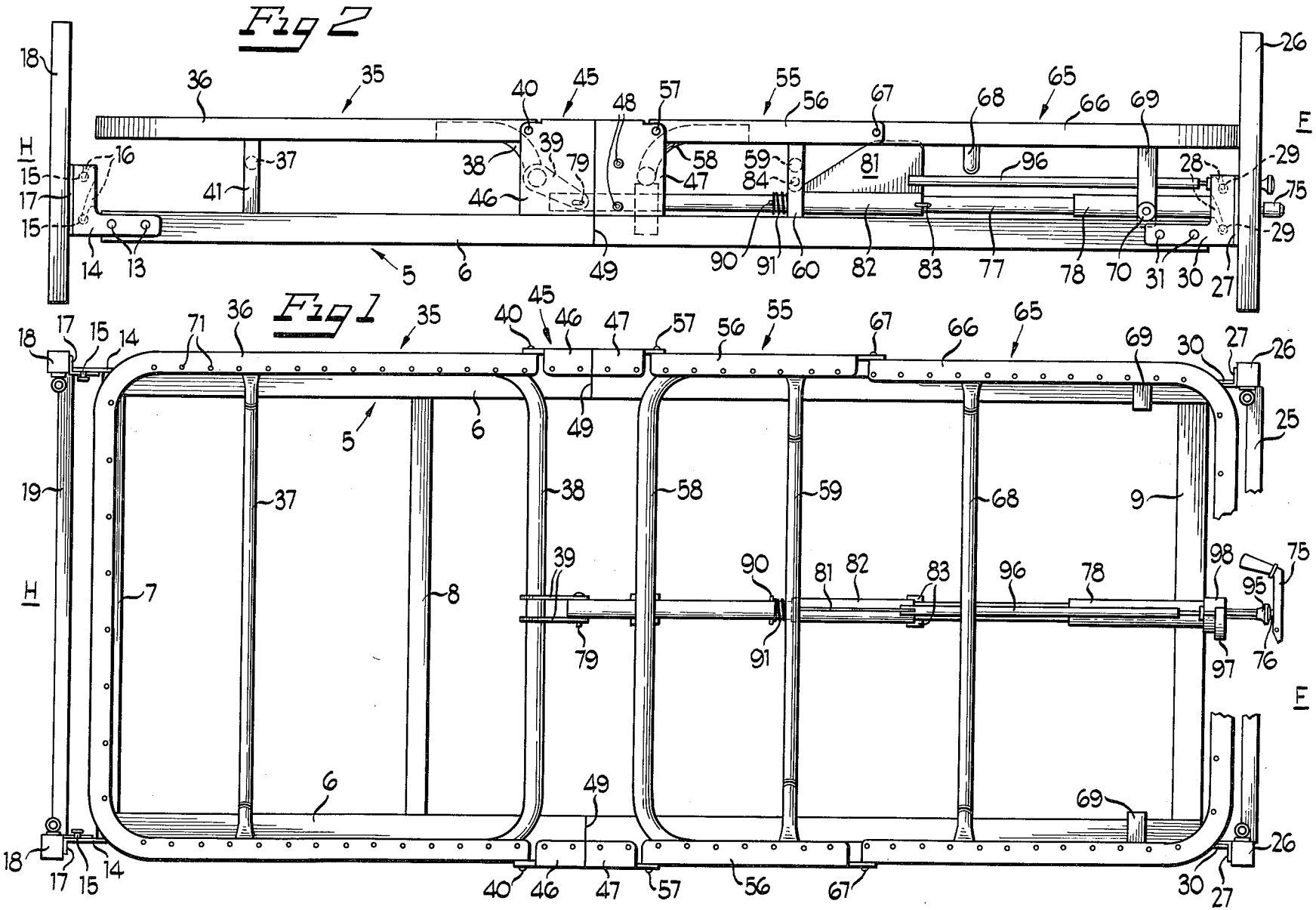
FIG. 1 shows a top view of a manually adjustable bed which possesses a knee cam to elevate the knee section with the head section.
FIG. 2 gives a side view of the same bed of FIG. 1. The knee cam in both FIGS. 1 and 2 occupies an elevated position where it will induce the raising of the knee portion.

The adjustable bed of FIGS. 1 and 2 displays many features typical of modern beds for nursing homes, hospitals and other such institutions. A lower frame, indicated generally at 5, supports the remainder of the mattress frame as well as the moving mechanical portions of the bed. The frame 5 includes a lower frame angle bracket 6 which runs the length of the bed on both of its sides. A head cross brace 7, a middle cross brace 8 and a foot cross brace 9 connect together the two lower angle brackets 6 to form a rectangular structure.

At the head end H of the bed, the fasteners 13 rigidly attach the head corner lock bracket 14 to the lower frame bracket 6. The rivets 15 protrude from the inside of the corner brackets 14 where they slide into the slots 16 of the head bed hook 17. The head bed hook 17, in turn, securely attaches to the head leg assemblies 18 which the head angle brackets 19 hold together.

Similarly, at the foot end F, the foot cross bracket 25 holds together the two foot leg assemblies 26. The foot hooks 27 rigidly attach to the leg assemblies 26 and have the slots 28 to entrap the rivets 29 of the foot corner lock brackets 30. The brackets 30 in turn fasten by means of the fasteners 31 to the lower angle brackets 6 to support them at the foot end F of the bed.

The head-end and foot-end slots 16 and 28, of course, allow the rivets 15 and 29 to raise out of them. This permits disassembling the lead leg assemblies 18 and the foot leg assemblies 26 from the lower frame 5 and the remaining mechanism of the bed.

Supported on the lower frame 5, the bed includes a head portion 35, a middle section 45, a thigh section 55, and a foot section 65. The head section 35 includes first a U-shaped head angle bracket 36. To provide additional support, the head section may include a support tube 37 welded to the bracket 36.

To permit its raising, the head section 35 also incorporates a head elevating tube 38 which has the eyelets 39 welded to it. The U-shaped head angle bracket 36, the head elevating tube 38, and the eyelets 39 possess a rigid spacial configuration with respect to each other. They rotate as a unit about the head pivot point at 40 when the head section elevates.

The screws at 40 attach the head section 35 to the middle section 45. When the head section 35 rotates about the point 40 to its lowest position, the levelizer 41, which attaches to the head angle bracket 36, rests upon the lower bracket 6 and supports the U-shaped angle bracket 36 in a parallel relationship with the lower angle bracket 6.

The middle section 45 includes the two plates 46 and 47 which, at their top, form angle brackets to help support a mattress. The thumb screws 48 retain extensions of the plates 46 in a fixed relationship to the plates 47. Removing the screws allows the plates to separate from each other as well as the lower angle bracket 6 along the midline 49. When this occurs, the entire structure divides along this midline 49 for more facile storage.

The knee portion of the bed actually includes both the thigh section 55 and the foot section 65. The thigh section includes first the angle brackets 56. The fasteners at 57 pivotally connect these brackets 56 to the middle section plate 47 at the thigh pivot point 57. To provide rigidity, the thigh section 55 includes the support tube 58 and the thigh elevating tube 59, both welded to the angle brackets 56. As its name implies, the thigh elevating tube 59 also functions in the rising of the knee portion of the bed.

The thigh section 55 further includes the thigh leveler 60 welded to the thigh angle brackets 56. As with the head leveler 40, the thigh leveler 60 rests upon the lower angle bracket 6 when the thigh section has reached its lowest position. This insures that the thigh section rests parallel to the lower angle brackets 6 to form a flat bed.

The foot section, which forms part of the knee portion, includes the U-shaped angle bracket 66. At its ends, the U-shaped angle bracket 66 attaches to the knee pivot point 67 where fasteners pivotally hold it. The support tube 68 lends rigidity to the foot section 65 although not all beds require it.

Figures 3, 4, 5:
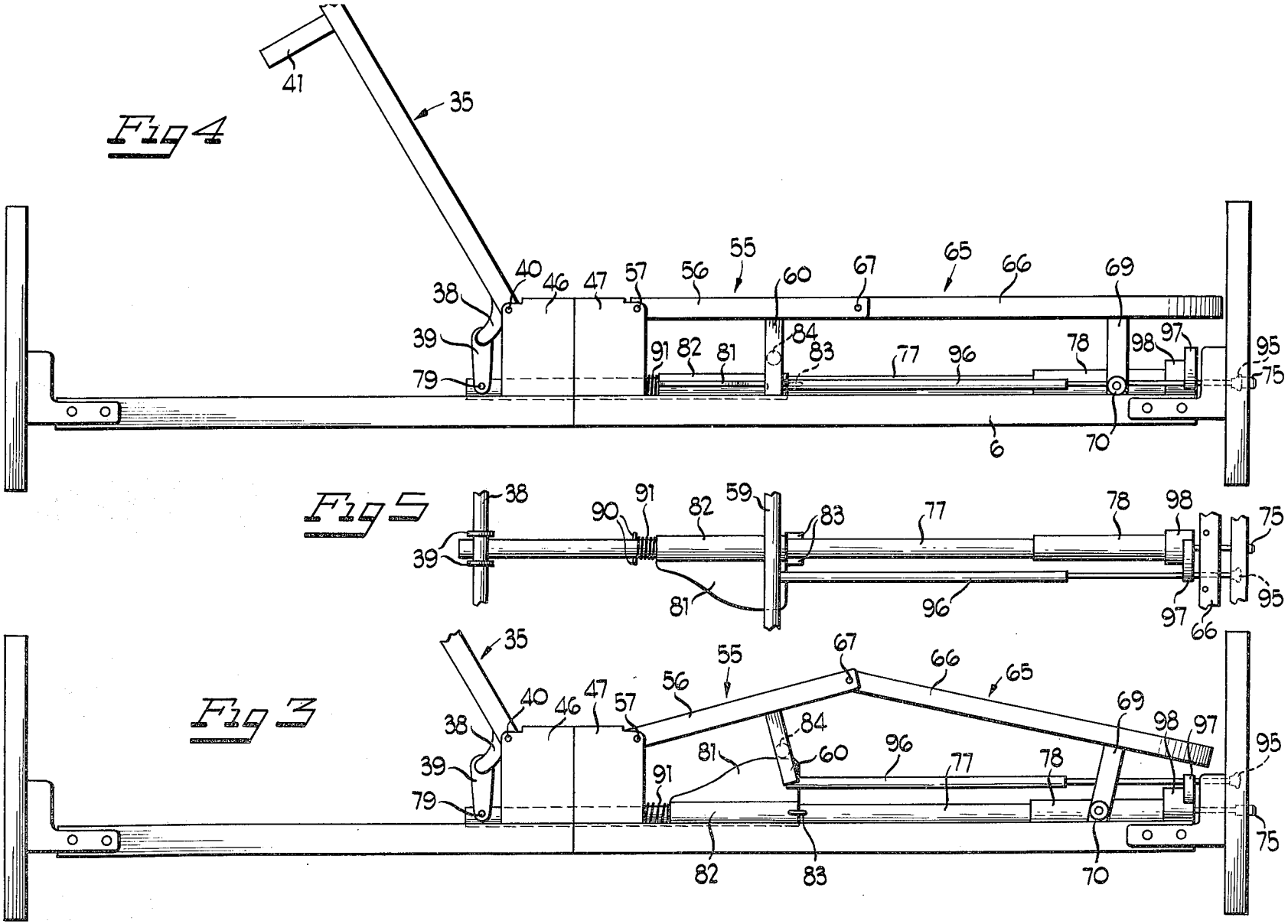
FIG. 3 displays a view of the same bed as the prior FIGURES except that the cam has raised the knee portion of the bed as the head portion elevated.
FIG. 4 shows the same bed of FIGS. 1, 2 and 3 and with the head section raised. Here, the knee cam occupies a lateral position in which it does not raise the knee portion of the bed.
FIG. 5 gives a top view of the knee cam mechanism in the lateral position which it occupies in FIG. 4.
Figures 6, 7, 8:
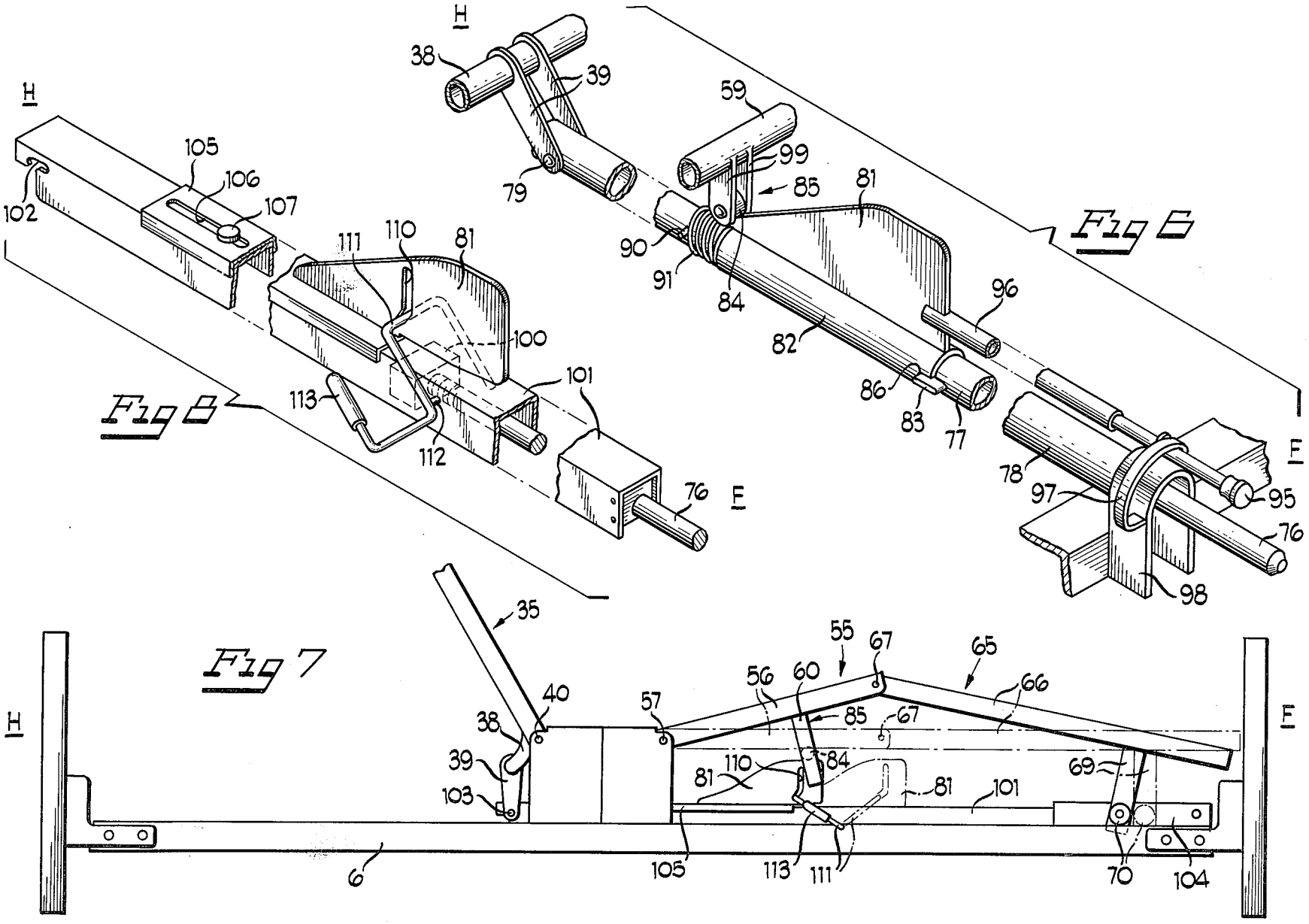
FIG. 6 has a perspective view of the head and knee raising mechanism of the bed of the prior FIGURES with the knee cam occupying a vertical position.
FIG. 7 shows a side view of a bed having an alternate form of knee cam mechanism. The cam moves translationally out of and into its position where it will raise the knee as the head elevates.
FIG. 8 gives a perspective view of the alternate mechanism of FIG. 7.

Lastly, the foot levelizer 69 forms part of the foot section 65. As shown in FIGS. 3, 5 and 7, the head levelizer 40 and the thigh levelizer 60 raise from the lower angle bracket 6 upon the raising, respectively, of the head section 35 and the thigh section 55. As shown in FIG. 5, the knee portion raises by the elevation of the knee pivotal point 67. The foot levelizer 69 accordingly remains in contact with the lower angle bracket 6, supporting the lower end of the foot section 65. As the thigh and foot sections 55 and 66 elevate to raise the knee, the foot levelizer 69 moves along the lower angle bracket 6. To facilitate this movement of the foot levelizer 69, it includes a roller 70 which makes the actual contact with the lower angle bracket 6.

Lastly, the head angle bracket 36, the middle brackets 46 and 47, the thigh brackets 56 and the foot bracket 66 include on their upper surface openings 71 passing through them to allow for the attachment of a bed spring in the usual fashion. Moreover, the support tubes 37, 59 and 68 bend below the level of the spring to allow the spring to depress under the weight of a patient and not make contact with these supports.

The crank handle 75 permits the elevation of the various bed portions. The handle 75 connects to the head elevating screw 76 which the FIG. 6 shows more clearly. The screw 76 in turn terminates inside of the head adjusting tube 77. The end of the screw 76 has a threading which engages a nut affixed to the side of the tube 77. Rotation of the screw 76 by the handle 75 results in translational or longitudinal motion of the tube 77. The crank guide 78 retains the tube in its proper position as well as preventing the pinching of extraneous items as it moves toward the foot F of the bed.

The end of the tube 77 has pins 79 which engage openings in the eyelets 39. Turning the screw to force the tube 77 towards the head H of the bed moves the end of the eyelets with the holes engaged by the pin 79 towards the head H. This force on the eyelets, welded to the tube 38, exerts a torque, or a rotational motion, on the eyelets 39, the tube 38 and the head section 35 clockwise in FIG. 2 around the head pivot point 40 to raise the head. Similarly, turning the screw 76 in the opposite direction pulls the eyelets 39 towards the foot of the bed and rotates the head section 35 counterclockwise around the point 40 in FIG. 2 to lower it. A motor, rather than the crank handle 75, would suffice to impart the desired translational motion to the tube 77.

The knee portion, consisting of the thigh and foot sections 55 and 65, may or may not elevate with the head portion 35, depending upon the position of the cam 81. In the FIGS. 1, 2, 3 and 6, the cam 81 occupies a vertical position. A permanent welding attaches the cam 81 to the cam tube 82 which concentrically surrounds the head adjusting tube 77, but with rotational freedom. The knee break lands 83 project from the head adjusting tube 77 to which they rigidly attach. As the tube 77 moves, under the pressure of the screw 76, towards the head of the bed, the lands 83 similarly force the cam tube 82 and the cam 81 in that direction. As the lands 83 move the cam 81 forward, the cam, when in its vertical position, contacts the roller 84 of the cam follower 85 attached to the thigh elevating tube 59. As the cam 81 continues to progress toward the head H, it forces the roller 84, the cam follower 85, the thigh elevating tube 59 and thus the thigh section 55 upwards. The raising of the thigh section also elevates the foot section 65 resulting in the elevated knee portion shown in FIG. 3.

Moving the head adjusting tube 77 in the opposite direction lowers the head section 35 and moves the pins 90 into compression against the spring 91 which pushes the cam 81 towards the foot of the bed. As the cam 81 moves towards the foot, the knee section composed of the thigh and foot sections 55 and 65, lowers until once again reaching its flat position.

The cam 81, however, may also occupy a horizontal rather than a vertical position. When this occurs, it cannot contact the cam follower 85 when the head adjusting tube 77 forces the cam towards the head H of the bed. In this instance, the cam does not force the knee portion of the bed to rise as the head section elevates.

The release handle 95 controls the attitude of the cam 81. To move it from the vertical as shown in FIGS. 1, 2, 3 and 6, to the horizontal as in FIGS. 4 and 5 requires first pushing the release handle 95 towards the head of the bed H.

Moving the handle 95 towards the head H also pushes the cam release rod 96 in the same direction. This moves the cam 81 and the cam tube 82, but not the tube 77, towards the head until the indentations 86 on the cam tube 82 are free of the matching lands 83, as seen more clearly in FIG. 6. When the indentations 86 no longer engage the lands 83, rotating the handle 95 in a counterclockwise direction, as seen from the foot F of the bed, rotates the cam 81 also counterclockwise until it occupies the horizontal attitude shown in FIGS. 4 and 5. The knee break bracket 97 attached to the head elevating tube support 98 guides the handle 95 and the rod 96 during the rotational motion.

When the cam 81 occupies this horizontal attitude, rotating the crank handle 75 will force it towards the head H as with the cam in the vertical position. However, lying on its side, the cam 81 cannot raise the knee portion of the thigh and foot sections 55 and 65. However, since the cam 81 does not affect the head portion 35, rotating the crank handle 75 will still raise the head portion 35 to achieve the configuration shown in FIG. 4. As seen there, the head portion 35 occupies an elevated section, with the thigh section 55 and foot section 65 remaining at their lowest, flat position, parallel with the lower angle bracket 6.

The lands 83 engaged with the indentations 84 on the cam tube 82 prevent the accidental rotation of the cam 81 from the vertical to the horizontal position. An intended pushing of the knob 95 to free the indentations 86 must precede the rotation of the cam 81. Without depressing the handle 95, the spring 91 forces the cam tube 82 towards the foot of the bed to engage the indentations 86 with the lands 83.

Furthermore, when the cam 81 has actually forced the knee portion to an elevated position, the handle 95 and rod 96 cannot effect rotation of the cam 81 to its horizontal position. With the cam follower 85 in actual contact with the cam 81, the sides 99 of the follower extend below the roller 84 and prevent the rotation of the cam 81 even when attempted by the handle 95.

The bed in FIGS. 7 and 8 employs an alternate mechanism to control the raising of the knee when elevating the head. As with the prior figures, a screw 76 turned by a handle has a threaded end which engages a nut 100 rigidly attached to the head elevating channel 101. Rotating the screw 76 results in longitudinal motion of this channel 101.

The eyelet guides 102 at the head end of the channel 101 engage pins 103 on the eyelets 39. As the channel 101 moves towards the head H, it exerts a rotational motion, on the eyelets 39, the head elevating tube 38, and, thus, the head portion 35 counterclockwise, in FIG. 7, around the head pivot point at 40. This rotational motion elevates the head 35. Similarly, moving the guide 101 towards the foot F results in the lowering of the head portion 35.

Again, the position of the cam 81 determines whether the knee portion of the bed will accompany the head portion in its raisings and lowerings. However, rather than rotating from a vertical to a horizontal position to disengage, the cam 81 moves longitudinally backward along the channel 101 to avoid contact with the cam follower 85. Specifically, as shown in FIG. 8, the cam 81 rigidly attaches to the cam support 105 which fits neatly over the channel 101. The support 105 has a guide 106 in the form of a slot at its end. The screw 107 passes loosely through the guide 106 and attaches to the channel 101 itself. The screw serves to hold the cam support 105, and thus, the cam 81, to the channel 101 while allowing it the necessary longitudinal motion along the channel.

The cam 81 has a slot 110 cut from it, through which the knee break handle 111 passes. The handle 111, in turn, pivotally connects to the channel 101, with the spacers 112 on either side providing clearance between the handle 111 and the channel 101. Moving the handle cover 113 forward towards the head H or backwards towards the foot F results in the rotation of the handle 111 at its attachment to the channel 101.

Specifically, as the handle 111 moves towards the head H, it presses against the forward edge of the slot 110 and moves the cam 81 towards the head, as shown in FIG. 8. If the channel 101 then moves towards the head of the bed while the cam 81 occupies this forward position, the cam 81 will contact the roller 84 of the cam follower 85 to raise the knee, as shown in solid in FIG. 7.

The forward slant of the bottom of the slot 110 on the cam 81 acts as a toggle mechanism to prevent the cam 81 from sliding backward along the channel 101 under the weight of the knee of the bed acting through the cam follower 85. This shape of the slot 110 actually results in the secure lodging of the cam 81 in its forward position under the weight of the bed.

Alternatively, moving the handle cover 113 towards the foot F also moves the handle 111 and thus the cam 81 in that direction. When occupying its rear most position, the cam 81 will not engage the cam follower 85 over any part of the range of motion of the channel 101. Thus, the channel 101 may move forward towards the head H and raise the head portion 35 to its maximum elevation without the cam 81 engaging the cam follower 85 or raising the knee. FIG. 7 shows the head portion 35 elevated, but also, in phantom, the cam 81 in its rear most position and the thigh and foot sections 55 and 65, also in phantom, in their flat position.

The channel cover 104 covers the space left vacant when the channel 101 moves towards the head H of the bed. This precludes the entrapping or pinching of items in that space when the channel 101 returns towards the foot F.

What is claimed is:

1. In an adjustable bed of the type having a movable head portion, head adjusting means coupled to said head portion for moving said head portion, and a movable knee portion, the improvement comprising knee adjusting means connected to said head adjusting means, having an active configuration and an inactive configuration and movable between said active and inactive configurations for, when in said active configuration, raising said knee portion above the flat position during at least a part of the time said head adjusting means moves said heat portion, said knee adjusting means not moving said knee portion when in said inactive configuration, and shifting means for moving said knee adjusting means between said active and inactive configurations, wherein said knee adjusting means includes a cam and a follower and said cam, when said knee adjusting means is in said active position and moving said knee portion, presses against said follower, said cam being connected to said head adjusting means and said cam follower is connected to said knee portion, said head adjusting means includes an elongated member moving translationally when said head adjusting means moves said head portion, and said cam connects to said elongated member, said cam, when said knee adjusting means occupies said active configuration, has rotational separation from said follower when said knee adjusting means occupies said inactive configuration, and said shifting means rotationally moves said cam, retaining means for holding said knee adjusting means in said active configuration until said shifting means moves said knee adjusting means out of said active configuration when said shifting means moves said knee adjusting means in said active configuration, said head adjusting means includes hand crank means manually rotatable for moving said elongated member translationally, and wherein said cam, when said knee adjusting means is in said inactive configuration, does not touch said cam follower, said knee portion, or said head portion.

2. In an adjustable bed of the type having a movable head portion, head adjusting means coupled to said head portion for moving said head portion, and a movable knee portion, the improvement comprising knee adjusting means connected to said head adjusting means, having an active configuration and an inactive configuration and movable between said active and inactive configurations for, when in said active configuration, raising said knee portion above the flat position during at least a part of the time said head adjusting means moves said head portion, said knee adjusting means not moving said knee portion when in said inactive configuration, and shifting means for moving said knee adjusting means between said active and inactive configurations, wherein said knee adjusting means includes a cam and a follower and said cam, when said knee adjusting means is in said active position and moving said knee portion, presses against said follower, said cam being connected to said head adjusting means and said cam follower is connected to said knee portion, said head adjusting means includes an elongated member moving translationally when said head adjusting means moves said head portion, said cam connects to said elongated member, said cam, when said knee adjusting means occupies said active configuration, has translational separation from said cam when said knee adjusting means occupies said inactive configuration, and said shifting means translationally moves said cam, said cam when said knee adjusting means occupies said active configuration, has translational separation from said cam when said knee adjusting means occupies said inactive configuration, and said shifting means translationally moves said cam and retaining means for, when said shifting means moves said knee adjusting means to said active configuration, holding said knee adjusting means in said active configuration until said shifting means moves said knee adjusting means out of said active configuration.

3. The improvement of claim 2 wherein said head adjusting means includes hand crank means manually rotatable for, when rotated, moving said elongated member translationally.

4. The improvement of claim 3 wherein said cam, when said knee adjusting means is in said inactive configuration, does not touch said cam follower, said knee portion, or said head portion.

5. In an adjustable bed of the type having a movable head portion, adjusting means coupled to said head portion, and a movable knee portion, the improvement comprising cam-and-follower means for connecting the head and knee portions to move the knee portion when the head portion is moved, and manually operable means for disassociating the cam from the follower to move the head portion independently of the knee portion.

6. The improvement as described in claim 5, said cam being a plate cam, and said follower being a roller adapted to roll on said plate cam.

7. The improvement as described in claim 5, said means for disassociating the cam from the follower comprising a rotatable support for the cam, and means for rotating the cam into and out of alignment with the roller.

8. The improvement as described in claim 7, and including means for locking the rotatable support for the cam against rotation.

9. The improvement as described in claim 5, said means for disassociating the cam from the follower comprising a slidable support for the cam and means for sliding the cam into and out of contact with the roller.

10. The improvement as described in claim 8, said locking means comprising a spring-pressed interlock between the rotatable cam support and the adjusting means coupled to said head portion.

11. The improvement as described in claim 9, and means for locking the slidable support for the cam against sliding movement relative to the roller.

12. The improvement as described in claim 11, said locking means comprising a pivoted control device, and a pin-and-slot connection between the pivot control device and the cam, said connection having a dead-center position corresponding to the locked condition of said locking means.

* * * * *